United States Patent [19]

Waryasz

[11] Patent Number: 4,704,992

[45] Date of Patent: Nov. 10, 1987

[54] WATERWALL SUPPORT AND CONFIGURATION FOR A RANCH STYLE FLUIDIZED BED BOILER

[75] Inventor: Richard E. Waryasz, Longmeadow, Mass.

[73] Assignee: Combustion Engineering, Inc., Windsor, Conn.

[21] Appl. No.: 505,139

[22] Filed: Jun. 16, 1983

[51] Int. Cl.[4] ..... F22B 1/00

[52] U.S. Cl. ..... 122/4 D; 122/235 A; 165/83; 165/104.16

[58] Field of Search ..... 122/4 D, 235 A; 165/83, 165/104.16

[56] References Cited

U.S. PATENT DOCUMENTS

| | | | |
|---|---|---|---|
| 153,776 | 8/1874 | Mason | 165/83 |
| 2,375,702 | 7/1943 | Smith | 165/83 X |
| 3,127,200 | 3/1964 | Sayag | 165/83 X |
| 4,167,157 | 9/1979 | Zielinski et al. | 122/4 D |
| 4,418,652 | 12/1983 | Rees | 122/235 A |

*Primary Examiner*—Edward G. Favors

*Attorney, Agent, or Firm*—Arthur E. Fournier, Jr.

[57] ABSTRACT

The essential components of a utility boiler utilizing a fluidized bed combustor are disclosed in sufficient detail to depict top suspension of the waterwalls enclosing the freeboard of the bed, support of the fluidized bed from ground level, and an expansible junction in the waterwalls to accommodate vertical movement due to thermal changes.

3 Claims, 2 Drawing Figures

WATERWALL SUPPORT AND CONFIGURATION FOR A RANCH STYLE FLUIDIZED BED BOILER

TECHNICAL FIELD

Figure 1:
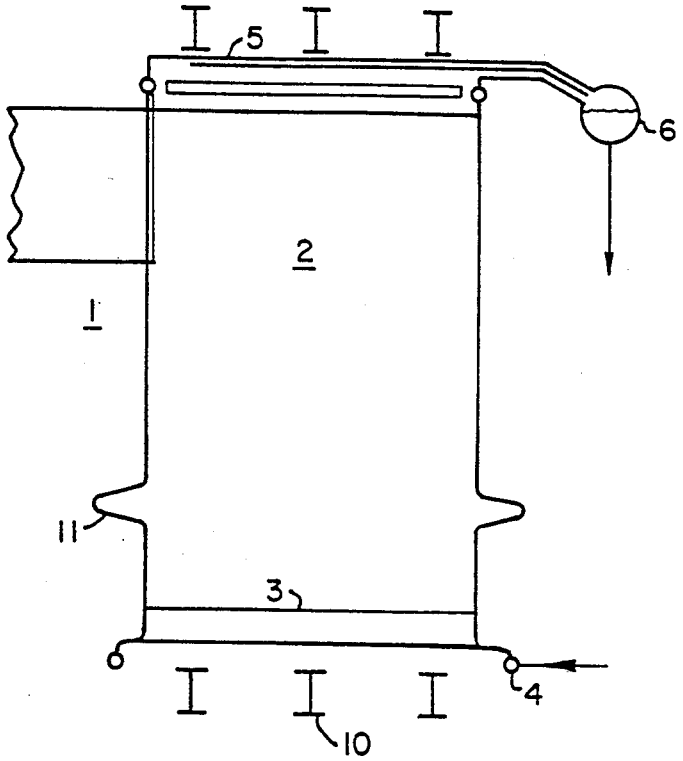

The present invention relates to a fluidized bed-heated waterwall furnace support. More specifically, the invention relates to provisions for expansion and contraction of the heated waterwalls of a furnace in which the fluidized bed is supported from ground level, and the convective section of the furnace is top-supported.

BACKGROUND ART

There is an effort to utilize the potential in this country for producing coal as a primary source of fuel. There are problems in adapting the fluidized bed combustor to furnaces of utility-sized boilers. Industry is going through a new cycle where boilers must be adapted to utilize a fluidized bed for burning coal. The fluidized bed combustor has experimentally achieved acceptable levels of combustion efficiency and sulfur capture.

In obtaining full benefit from the effects of freeboard residence time and recycle, a "ranch style" fluidized bed was chosen. The name is derived from the arrangement of the fluidized bed on a single elevation. It was selected as the best from eight configurations. The eight concepts were essentially variations of three basic types: the ranch, a single vertical stacked bed arrangement, and a multiple stacked bed design.

Limitations in forming the fluid bed cells in the stacked design result in additional waterwall surface area; thus, the freeboard temperature tends to drop rapidly, reducing the residence time at useful temperatures to below two seconds. In the ranch design, a large freeboard is provided above the bed. The residence time in the freeboard was found to be three seconds for a 200-MW boiler, increasing to 5 seconds in an 800 MW unit. The relationship between freeboard volume and heat-absorbing wall surface is such that the temperature in the freeboard remains high enough to support additional completion of the combustion and sulfur capture reactions.

Elutriated fines are captured by a dust collector and recycled through the bed to increase the residence time of solids in the system. The freeboard residence time of 3 to 5 seconds enables additional reaction between solids and gases above the bed. The release of energy above the bed produces temperatures as high as 1700° F. which aids in the burn-out of carbon and in reduction reactions between carbon and oxides of nitrogen which minimize NOx emissions. The long freeboard residence time permits the effective use of overfire air. While the overall excess air is 20%, the bed can be operated at lower excess air, producing conditions favoring NOx reduction in the bed and in the lower section of the freeboard. This excess air level must be sufficient to prevent reducing conditions that could promote corrosion. The remaining excess air is injected into the freeboard to promote gas mixing and improve carbon burn-up.

In addition to using a design approach well suited to the fluidized bed process, the ranch design provides advantages in the mechanical design of supporting auxiliary equipment. With the bed on a single elevation, fuel and bed drain piping and air ducting are easily routed to the bottom of the boiler. Maintenance is simplified with accessibility near ground level to the major auxiliary equipment for fluidized bed operation.

A minimum of structural steel is used for the boiler in the ranch configuration. A fluidized bed, which contains a large inventory of material, is bottom supported by ground level steel structure. These substantial loads, as well as the dynamic forces of fluidization, are carried very efficiently. The relatively light freeboard structure and convective sections require top support in the conventional manner. However, the top-supported loads are significantly less than even in a conventional boiler. The savings in structural steel represent a major cost reduction over stacked bed designs. With both top and bottom support of the boiler, the problem of compensating for thermal expansion and contraction requires a solution not heretofore evident.

DISCLOSURE OF THE INVENTION

The present invention contemplates a ground-supported ranch style fluidized bed combustor having a top-supported freeboard enclosure joined by an expansible structure maintaining the integrity of the waterwalls, while compensating for the vertical movement of expansion and contraction.

The invention further contemplates an expansible structure in the waterwalls of a top and ground-supported furnace fired by a fluidized bed combustor formed with the membrane and tube construction of the waterwalls.

The invention further contemplates the membrane and tube waterwall construction of the expansible structure in the form of a bellows.

Other objects, advantages and features of this invention will become apparent to one skilled in the art upon consideration of the written specification, appended claims, and attached drawings.

BRIEF DESIGNATION OF THE DRAWINGS

Figure 2:
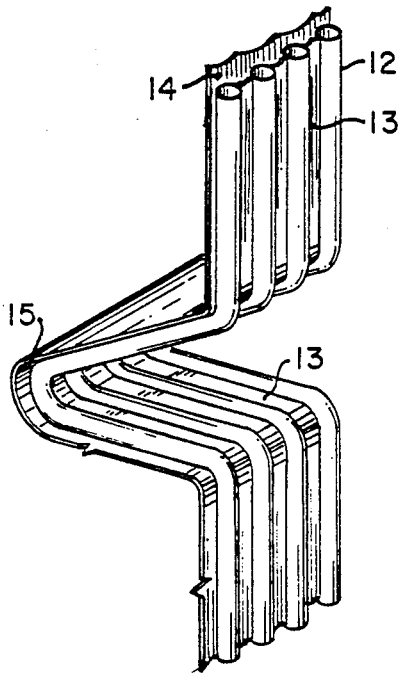

FIG. 1 is a sectioned elevation of a utility boiler fired by a fluidized bed combustor including the present invention; and FIG. 2 is a perspective view of a section of the waterwalls of the furnace of FIG. 1 disclosing the expansible structure between the ground-supported bed and the top-supported freeboard-convective section.

BEST MODE FOR CARRYING OUT THE INVENTION

General Observations

The concepts of this disclosure can be found in TIS-7253 of Combustion Engineering, Inc. containing material presented at The Seventh International Conference On Fluidized Bed Combustion, authored by Joseph R. Comparato. This publication documented a design study of a hypothetical 200-MW fluidized bed boiler for Tennessee Valley Authority (TVA), by Combustion Engineering, Inc. Justification for the type of fluidized bed combustor was made and the feasibility of the separate support of the bed and convective section was examined. A 30-year life expectancy was projected for the integrity of the transition section in the waterwalls.

The concepts of the present invention are readily gathered from the present disclosure. In boilers of utility size, thermal cycling of the furnace sections conventionally dictate support from external structures. These envelopes are expected to expand and contract vertically downward from their top support. This conventional expectation had to be modified with the advent of the fluidized bed combustor and its inventory of solid fuel and sorbent for sulfur compounds. The weight of this bed and its inventory simply had to be supported from ground level.

The freeboard above the bed must be enclosed by waterwall structure for the basic absorption of both radiant and convective heat from the bed combustion. This waterwall enclosure had to be top supported as it vertically extended and contracted during operation of the boiler. The result was a union of two structures forming the furnace of the boiler, one supported from ground level, and one supported from the top. The juncture of these two structures required absorption of their relative vertical movements while maintaining the integrity of the tube system lining the walls to carry the feedwater and steam generated by the heat of combustion.

In summation, the invention first includes the separate support for the furnace sections. Secondly, the invention includes structure of the transition section in the waterwalls which accommodates relative vertical movement of the two sections of the furnace.

The Boiler

FIG. 1 represents the essential components of a utility boiler in which the source of combustion is the solid fuel on a ranch-type fluidized bed combustor. The vertical shell 1 comprises the envelope which encloses the freeboard volume 2 above the combustion sustained on bed 3. A network of tubes line the interior walls of shell 1 so that they will be exposed directly to the radiant and convective heat of the combustion. Feedwater is supplied through conduit 4 to this network of tubes. The water absorbs the heat of combustion in its flow upward through the tube network. Outlet conduit 5 represents the means by which the steam and water mixture is withdrawn from the tube network. From exposure to the combustion heat, the steam anc water mixture is passed to a conventional steam drum 6 where the steam is separated from the water and ultimately passed to a turbine not shown. The steam condenses, is recycled with any additional feedwater required, and joins the separated feedwater from the drum for recycling through the tubes of the waterwalls. With the exception of the waterwalls, these conventional structures of the utility boiler are disclosed only perfunctorily. Certainly, these items are necessary to the complete function of the boiler, but are adjunct to the invention to be disclosed here.

As indicated previously, bed 3 and its inventory of solids presents a problem of support. It is evident that the support must come from a structure extending upward from ground level. These structural members are generally indicated at 10 and need not be analyzed in detail, but are made up of conventional steel beams, struts, etc. Also, it is not necessary to show the details of the fuel supply and absorbent supply for the bed inventory, nor the arrangements for renewing spent material following combustion. Of immediate concern is the arrangement of support for the bed and its inventory from ground level in contrast with the support for shell 1 from its top.

Shell 1 is anticipated to be a tall enclosure for the freeboard above the bed. All the generated combustion takes place within the bed and freeboard for the basic purpose of transmitting as much of the heat of combustion as possible to the water coarsing up through the tube network of the waterwalls. It is not practical for the vertical expansion and contraction of shell 1 to take place at its top. Rather, the shell must be basically supported from its top with sufficient freedom of its bottom to move the vertical distance necessary in response to the varying thermal load within.

Now arises the problem of mating the bottom of shell 1 with the upper end of bed 3. More specifically, the lower portion of the waterwall is mounted on the periphery of bed 3 to extend upward, while the lower end of the waterwall of shell 1 extends downward. Of course, there can be no interruption in the tube network of the waterwall. Therefore, any transition section between the upper and lower portions of the waterwalls must be thermally insulated and gas tight. Several different arrangements are conceivable for providing this integrity for the waterwalls during the give and take of thermal cycling, but the present invention is embodied in a particular form which is unique. Transition section 11 of the waterwall is shown, actually, to be an extension of both upper and lower portions of the waterwalls and roughly froms a U-shape, as disclosed in sectioned elevation in both figures. This U-shape will provide a vertical flexibility with which to accommodate expansion and contraction movements to which the waterwalls are subject during thermal cycling within the freeboard.

FIG. 2 discloses the essential elements of transition section 11 to a better advantage than that of FIG. 1. The reaches of the waterwall tubes 12 are disclosed as extending vertically. Each tube is linked to its neighbor by a connecting web or membrane 13. The completed formation of tubes and membrane are exposed on one side to the freeboard combustion heat, and on the other side to insulation or refractory 14. Insulation/refractory 14 is contained by an outside wall 15 which is the external skin of shell 1. In summation, shell 1 is comprised of the skin 15, the refractory 14, and the tube-membrane waterwalls.

As can be seen in FIG. 2, the transition section 11 is, essentially, an extension of the two portions of the waterwalls. Only one "fold" is provided in the drawing for the waterwalls in forming the transition section 11. This section may also be defined as bellows-like in configuration. More than one fold, or bellows segment, could be provided under the concepts of the invention. The drawing disclosure represents the configuration in the most simple of possible forms. Computer analysis of the fatigue life of this construction is established as in the order of 30 years; therefore, this configuration in the waterwalls is practical for an acceptable length of time. It supports the basic concept of dividing support for the freeboard shell from both below the fluidized bed and from above the top of the shell enclosing the freeboard volume of the bed.

A final word appears desirable on the integrity of the tube-membrane composition of the waterwalls. It is presently expected that the linkage between the tubes and the membrane will be unbroken and this continuous structure will be distorted as disclosed, to give the required flexibility in responding to thermal cycling. However, it is additionally anticipated that a deliberate opening may be desirable to lengthen the life of the transition section. If an opening is provided, probably a horizontal slit through the membrane or between the membrane and tube, the thermal and gas pressure integrity will be violated. In such arrangement, the insulation/refractory 14 could be composed and arranged to back up the interrupted waterwall to satisfactorily contain the heat and gas within the freeboard space above the bed.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A utility type boiler having a waterwalled furnace fired by a ranch-type fluidized bed combustor, including.

a ground-level support structure for the bed, a first section of waterwall extending vertically upward from the periphery of the bed in formation of the lower part of an enclosure for the freeboard volume above the bed, a second section of waterwall extending downwardly from top support to form an upper part of the freeboard volume, and a vertically flexible waterwall section as a transition between the first and second waterwall sections to accommodate vertical movement of the upper and lower waterwall sections relative to each other.

2. The boiler of claim 1, wherein, the waterwall sections are formed by linking vertically extended parallel tubes by membranes to form a gastight freeboard enclosure for the furnace section of the boiler.

3. The boiler of claim 2, in which, the transition waterwall section is provided a bellows configuration with sufficient flexure to accommodate the vertical relative movement of the two waterwall sections.

* * * * *